United States Patent [19]

Rainer et al.

[11] Patent Number: 4,516,589

[45] Date of Patent: May 14, 1985

[54] NON-COMBUSTIBLE CARBONIZED CIGARETTE FILTERS

[75] Inventors: Norman B. Rainer, Richmond; Charles S. McClung, Prince George, both of Va.

[73] Assignee: Philip Morris Incorporated, New York, N.Y.

[21] Appl. No.: 379,556

[22] Filed: May 18, 1982

[51] Int. Cl.[3] ..... A24D 3/06; A24D 1/18

[52] U.S. Cl. ..... 131/331; 131/359; 131/369; 131/334; 131/341; 131/342

[58] Field of Search ..... 131/331, 333, 334, 341, 131/342, 369, 359

[56] References Cited

U.S. PATENT DOCUMENTS

| | | | |
|---|---|---|---|
| 1,879,128 | 9/1932 | Desper | 131/369 |
| 2,329,927 | 9/1943 | Morton | 131/369 |
| 2,580,568 | 1/1952 | Matthews et al. | 131/369 |
| 2,580,609 | 1/1952 | Schur et al. | 131/369 |
| 2,580,610 | 1/1952 | Schur et al. | 131/359 |
| 2,907,686 | 10/1959 | Siegel | 131/369 |
| 3,276,453 | 10/1966 | Corley | 131/369 |
| 3,943,941 | 3/1976 | Boyd et al. | 131/369 |
| 4,044,777 | 8/1977 | Boyd et al. | 131/369 |
| 4,079,742 | 3/1978 | Rainer et al. | 131/369 |
| 4,146,040 | 3/1979 | Cohn | 131/369 |
| 4,219,031 | 8/1980 | Rainer et al. | 131/369 |
| 4,256,123 | 3/1981 | Lendvay et al. | 131/359 |
| 4,256,126 | 3/1981 | Seligman et al. | 131/359 |
| 4,286,604 | 9/1981 | Ehretsmann et al. | 131/359 |

FOREIGN PATENT DOCUMENTS

| | | |
|---|---|---|
| 859399 | 4/1978 | Belgium . |
| 1100745 | 5/1981 | Canada . |
| 2744728 | 4/1978 | Fed. Rep. of Germany . |
| 2366807 | 5/1978 | France . |
| 39-21655 | 10/1964 | Japan . |
| 43-23970 | 10/1968 | Japan . |
| 43-23980 | 10/1968 | Japan . |
| 1023918 | 3/1966 | United Kingdom . |
| 1033818 | 6/1966 | United Kingdom . |
| 2064293 | 6/1981 | United Kingdom . |
| 1597101 | 9/1981 | United Kingdom . |
| 1597102 | 9/1981 | United Kingdom . |
| 1597103 | 9/1981 | United Kingdom . |
| 1597104 | 9/1981 | United Kingdom . |
| 1597105 | 9/1981 | United Kingdom . |
| 1597106 | 9/1981 | United Kingdom . |
| 1597107 | 9/1981 | United Kingdom . |

*Primary Examiner*—V. Millin

[57] ABSTRACT

Non-combustible carbonized cigarette filters are manufactured wherein porous cellulosic material is contacted with a film-forming aqueous solution of an inorganic salt selected from the group consisting of alkali metal and ammonium silicates, carbonates, hydrophosphites, diphosphites, phosphites, hypophosphates, orthophosphates, diphosphates, triphosphates, polymetaphosphates, peroxymonophosphates, peroxydiphosphates, orthoborates, metaborates, tetraborates and mixtures thereof so that the cellulosic material contains at least about 1%, preferably from about 2% to about 6%, of the salt on a dry weight basis and then pyrolyzing the treated cellulosic material in an inert atmosphere at a temperature of at least about 700° C. to about 900° C., under conditions such that at least about 15%, preferably from about 20% to about 40% of the initial weight of the cellulosic material remains after pyrolysis.

8 Claims, No Drawings

NON-COMBUSTIBLE CARBONIZED CIGARETTE FILTERS

BACKGROUND OF THE INVENTION

The present invention relates to a process for making non-combustible carbonized cellulosic material, and more particularly to non-combustible carbon filters made of such material and to smoking articles which contain such filters.

The use of carbonized matter as a filter or filtration enhancer and as a partial or total substitute for the customary tobacco shred content of a cigarette have been reported, as have various methods of manufacturing such filters and cigarettes.

U.S. Pat. No. 4,219,031 discloses a smoking product having a central, porous, combustible core of carbonized matter circumscribed by tobacco shreds. The core is produced by pyrolyzing a rod of loosely twisted, or substantially non-woven, cellulosic material which has been treated with an additive for ash control to produce a carbonized rod consisting of at least about 80% carbon. The ash control additive may be $Na_2B_4O_7$, $CaCl_2$ or $K_4Fe(CN)_6$.

Commonly assigned, co-pending U.S. application Ser. No. 296,233, filed Aug. 25, 1981, discloses a method of making a combustible carbonized rod for use in a smoking product. According to the method disclosed, a cellulose rod comprising a coherent bundle of cellulosic paper made by the wet paper-making process, and which contains a binding agent and an additive selected from the group of compounds consisting of $Na_2B_4O_7$, $CaCl_2$, $K_4Fe(CN)_6$, $Al_2(SO_4)_3$ and $Cu_3SO_4$, and mixtures thereof, is pyrolyzed. The binding agent is preferably one or more of the aforementioned additives, and thus the rod is preferably formed using the additive as the binding agent. The resultant carbonized rods are employed as filters in smoking products either alone or in addition to a conventional filter, such as a cellulose acetate filter, and exhibit properties of filtration which are superior to those of conventional cellulose acetate filters.

Definitions

Carbonized

Carbonized is used herein to denote that during pyrolysis the cellulose is converted to a substance that, by elemental analysis, consists of at least 80 percent carbon exclusive of ash-forming ingredients.

Resistance-to-Draw (RTD)

RTD is determined as follows. A vacuum system is set to pull an air flow of 1050 cc/minute by inserting a standard capillary tube through the dental dam of a cigarette holder and adjusting the air flow through the capillary tube until the correct reading of the pressure drop across the capillary tube in inches of water, as measured on an inclined water manometer, is obtained. Then the butt end of a cigarette is inserted to a depth of 5 mm in the dental dam of the cigarette holder. The pressure drop behind this cigarette with 1050 cc/minute of air flowing through is read directly as RTD in inches of water.

Total Particulate Matter (TPM)

The particulate matter of tobacco smoke consists of minute liquid particles condensed from the vapor formed by the combustion of the cigarette and suspended in the smoke stream. These particles are collectively referred to as the total particulate matter, which for convenience may be referred to as "TPM". The TPM content of smoke is measured by determining the weight of material trapped on a Cambridge filter pad under standard machine-smoking conditions.

SUMMARY OF THE INVENTION

A process is provided for making non-combustible carbonized material according to which porous cellulosic material is contacted with a film-forming aqueous solution of an inorganic salt selected from the group consisting of alkali metal and ammonium silicates, carbonates, hydrophosphites, diphosphites, phosphites, hypophosphates, orthophosphates, diphosphates, triphosphates, polymetaphosphates, peroxymonophosphates, peroxydiphosphates, orthoborates, metaborates, tetraborates and mixtures thereof so that the cellulosic material contains at least about 1%, preferably from about 2% to about 6%, of the salt on a dry weight basis. The treated cellulosic material is then pyrolyzed in an inert atmosphere at a temperature of at least about 700° C., preferably from about 750° C. to about 900° C., under conditions such that at least about 15%, preferably from about 20% to about 40% of the initial weight of the cellulosic material remains after pyrolysis.

When it is desired to make a non-combustible filter, it is preferred that a sheet of the cellulosic material be employed and that after it is contacted with the solution, it be laterally gathered and compressed into a substantially cylindrical coherent bundle and then pyrolyzed. The process may be conducted on a batch or a continuous basis. If desired, preformed rods of cellulosic material may be employed in which case they are impregnated with the solution and then pyrolyzed.

DESCRIPTION OF PREFERRED EMBODIMENTS

The non-combustible carbonized material of the present invention is produced by contacting porous cellulosic material with a film-forming aqueous solution of an inorganic salt, and then pyrolyzing the treated cellulosic material.

Suitable cellulosic materials include papers, fabrics, and textile-like, non-woven webs made from cotton, wood pulp, and other fine-dimensioned fibrous cellulosic substances. An isotropic orientation of the filaments in the plane of the web is generally preferable. Suitable papers may be creped or smooth and have weights from about 5 to 40 grams per square meter. Paper derived from wood pulp is the preferred cellulosic material, in view of its low cost and the fine dimensions of the individual cellulosic particles which constitute the paper structure. Particularly preferred is paper made from aqueous dispersions of wood pulp by the fourdrinier method.

The cellulosic material is contacted with a film-forming aqueous solution of an inorganic salt selected from the group consisting of alkali metal and ammonium silicates, carbonates, hydrophosphites, diphosphites, phosphites, hypophosphates, orthophosphates, diphosphates, triphosphates, polymetaphosphates, peroxymonophosphates, peroxydiphosphates, orthoborates, metaborates, tetraborates and mixtures thereof so that the treated cellulosic material contains at least about 1% preferably about 2% to about 6% of the salt on a dry weight basis. The inorganic salt is selected so as to provide a continuous film upon evaporation of the solvent. Preferred solutions are those containing a mixture of sodium tetraborate, potassium tetraborate or ammonium tetraborate and diammonium phosphate or dipotassium phosphate. Particularly preferred is a solution of sodium tetraborate and diammonium phosphate in a weight ratio of from about 3:1 to about 1:3.

The treated cellulosic material is then pyrolyzed in an inert atmosphere at a temperature of at least about 700° C., preferably about 700° C. to about 1000° C., so that at least about 15%, preferably at least about 20%, and more preferably from about 20% to about 40%, of the initial weight of the cellulosic material remains after pyrolysis. When cellulose is pyrolyzed, gaseous material, aerosolized particulate matter (TPM) and char are the major products. The char is the carbon. Any of the methods of pyrolyzing cellulosic material which are known to those skilled in the art may be employed. The resultant carbonized cellulosic material is non-combustible and, surprisingly, remains so even if thoroughly extracted with water to remove substantially all water-soluble components. Microscopic examination of the carbonized cellulosic material reveals retention of the general fibrillar configuration of the precursor cellulosic material.

Subsequent to formation, the carbonized material may optionally be subjected to an activation treatment by partial oxidative erosion at temperatures in the range of from about 750° C. to about 1050° C. Activation produces a high surface area which is capable of selectively absorbing certain smoke components.

The carbonized material produced according to the method of the present invention is non-combustible and exhibits properties of filtration which are superior to the properties of filtration of cellulose acetate which is conventionally used for filtration.

The non-combustible carbonized material of the present invention finds particular utility as a filtering agent whether in particulate, sheet, rod or some other such form. A preferred method which permits the manufacture of cylindrical or rod shaped lengths of non-combustible carbonized material will now be described. Such rods find particular utility as filters in smoking articles such as cigarettes.

According to this preferred method, a sheet of porous cellulosic web material is contacted with the film-forming solution and then formed while still wet into a substantially cylindrical coherent bundle, by laterally gathering and compressing the sheet. The cellulosic web material may preferably be longitudinally crimped either before or after it is contacted with the film-forming material. The forming operation is preferably effected by advancing the treated sheet material into a forming cone that laterally gathers and compresses it into a substantially cylindrical shape which is then dried. Suitable forming cones are known to those skilled in the art. Any suitable drying means such as a heated die or dielectric heating may be employed. Preferably, a heated die is employed whereby the forming and drying steps are accomplished in a single step. The dry, rod-shaped coherent bundle of cellulosic material will preferably have a density of between about 0.1 and about 0.4 gram/cc, exclusive of additives.

Subsequent to being contacted with the aqueous solution and prior to being formed into a coherent bundle, the sheet of cellulosic material may be treated with processing aids such as water, lubricants, or softening agents that make the cellulosic material more supple and amenable to a gathering or bundling operation to form the rod shaped structure. The processing aids will generally be removed during carbonization. Other additives may be incorporated into the cellulosic material to control the manner of carbonization.

The cross-sectional configuration of the resultant rod is characterized by the presence of random folds running generally parallel to its longitudinal axis and is further distinguished by the alignment of a substantial portion of the individual fibers, which constitute the web structure in directions transverse to the longitudinal axis.

The rod should possess sufficient rigidity in the absence of an outer wrapper to facilitate handling during the pyrolysis step. In order to enable the rod to be fed through a heated die during the pyrolysis step, the rigidity or stiffness should be at least 40 grams and preferably is in excess of 100 grams as measured by the weight in grams required to cause a 4 mm deflection at the midpoint of a rod horizontally supported at two points spaced 36.5 mm apart. An Instron Tensile Tester (made by Instron Engineering Corp., Canton, MA) coupled to a strip chart recorder was utilized to determine the applied force. The rate of downward movement of the force-applying member is 5 cm/minute, and the chart speed is 10 cm/minute.

A heated die maintained at a substantially constant temperature within the range of from about 700° C. to about 1000° C. is preferably employed to pyrolyze the rod. The heat treatment time (retention time in the die) is at least about 2 seconds, preferably about 3 seconds to about 30 seconds but is selected in conjunction with the temperature in order to insure that at least about 15%, preferably about 20% to about 40%, of the initial weight of the cellulose material remains after pyrolysis. Accordingly, the treatment temperature and the treatment time are selected to minimize weight loss and maximize the amount of char or carbon produced. Typically, the diameter of the pyrolyzed rod will be from about 15% to about 35% less than the diameter of the rod prior to pyrolysis.

The die is preferably a tapered die in order to achieve controlled compaction of the rod as it undergoes pyrolysis. The die provides a precise outer periphery for the resultant carbonized rod and may be of any reasonable length. The die is maintained at a substantially constant temperature by conventional means such as by thermostatically controlled electric resistance elements.

If oxygen is present at the inlet end of the die, the cellulosic material will tend to ignite upon contact with the heated die. Therefore, an inert atmosphere is maintained at the inlet end and may be established by placing the die in a chamber into which an inert gas, such as nitrogen, is introduced under a positive pressure to exclude oxygen from the chamber. The inert atmosphere may also be provided by the gaseous products of pyrolysis which may then be drawn off and recovered for their fuel value.

Flavoring agents or other ingredients may be applied to the carbonized rod by spraying, dipping, or other known methods to enhance the smoking characteristics of the smoking article in which the rod is incorporated as a filter.

Microscopic examination of the pyrolyzed rod reveals retention of the general fibrillar configuration of the precursor cellulosic material and carbonized bonding material which appears to bond the fibrous elements together. Such bonding material is thought to derive from the tar-like pyrolyzate generated during pyrolysis which condenses on the fibers in cooler regions of the rod upstream from the heated die and then undergoes carbonization to form rigid bridging between fibers; as well as from carbonization of binding agents, which may typically be added during formation of the coherent bundle of cellulosic material. This self-generated or autogenous carbonized bonding material improves the structural integrity of the carbonized rod and increases its flexural strength.

The flexural strength of the carbonized rod should be adequate to facilitate machine handling in the production of cigarettes. In order to possess adequate strength for use in cigarette fabrication, the carbonized rod should possess a flexural strength, measured as described above, greater than 10 grams and preferably greater than 40 grams.

The nature of the porosity of the carbonized rod is such that it contains greater than 60 percent and preferably from about 60 percent to about 95 percent volume of interconnecting void space ("void volume") as measured by the method of Hartung and Dwyer, reported in Paper #10 of the Tobacco Chemists Research Conference, October 1974. The percentage of open or void volume in a carbonized rod may also be ascertained by determining the volume of solid material within the rod using an air pycnometer and comparing this value with the total or envelope volume of the rod structure. It is believed that weight loss is generally related to the percent of pore volume. Pore volume in excess of 98.5 percent, although potentially desirable for smoking considerations, is associated with unsatisfactory low rod strength. Preferably, the carbonized rod will have an RTD of less than about 1 inch of water per inch of rod length.

The non-combustible carbonized rod, when employed as a filter in a cigarette, will have a length of from about 4 to about 40 mm, preferably from about 10 mm to about 25 mm, and a diameter substantially equal to the diameter of the tobacco column and may be employed in conjunction with a conventional filter such as a cellulose acetate filter, which conventionally is from about 10 mm to about 25 mm in length. The non-combustible filter is preferably positioned in abutting end-to-end relationship to the conventional filter and intermediate the tobacco column and the conventional filter or it may be spaced apart from the conventional filter. When spaced from the conventional filter, the space between the two filters may be a void or may contain materials capable of modifying the composition of the smoke. When employed in conjunction with a conventional filter, the non-combustible filter will typically have a length of from about 10 mm to about 25 mm and the conventional filter will typically have a length of from about 6 mm to about 15 mm. With dual filter cigarettes, an 80 percent reduction in TPM delivery has been obtained.

The non-combustible filter may also be employed as the only filter in a tobacco-containing cigarette and may be located at the mouth end of the cigarette, as is a conventional filter, or may be placed intermediate the ends of the cigarette with tobacco columns on either side of it. When employed as the sole filter in tobacco-containing cigarettes, the non-combustible filter of the present invention has been observed to deliver 40.1% less TPM on the average than tobacco-containing cigarettes equipped with a conventional cellulose acetate filter.

A particularly preferred embodiment of the present invention is a substantially cylindrical, non-combustible filter for a smoking article, such as a cigarette, which filter comprises laterally folded interbonded fibers of pyrolyzed porous cellulosic web material, having a substantially random distribution and containing from about 0.4 to about 1.2 percent by weight of elementally determined, water-insoluble boron and phosphorous. This filter is further characterized by a carbon content of at least about 75% by weight, a diameter of from about 5 mm to about 15 mm, a length of from about 4 mm to about 40 mm, a flexural strength of at least about 40 grams, a void space of from about 60% to about 95% and a resistance-to-draw of less than about 1 inch of water per inch of filter length.

EXAMPLES

The following examples present illustrative but non-limiting embodiments of the present invention. Comparative examples are also presented. Examples 1 and 2 were conducted on a batch basis on a lab scale whereas Examples 3 and 4 were conducted on a continuous basis on a pilot plant scale.

EXAMPLE 1

The following aqueous stock solutions were prepared as indicated in Table I below. Stock solutions (2) through (7) are comparative.

TABLE I

| Stock Solution No. | Solution Components | Concentration of component, % by weight |
|---|---|---|
| (1) | $Na_2B_4O_7$ | 1% |
| | $(NH_4)_2HPO_4$ | 2% |
| | $H_2O$ | 97% |
| (2) | $K_4Fe(CN)_6$ | 1% |
| | $(NH_4)_2HPO_4$ | 2% |
| | $H_2O$ | 97% |
| (3) | $K_4Fe(CN)_6$ | 1% |
| | $Mg(C_2H_3O_2)_2$ | 2% |
| | $H_2O$ | 97% |
| (4) | $K_4Fe(CN)_6$ | 1% |
| | $MgCl_2$ | 2% |
| | $H_2O$ | 97% |
| (5) | $K_4Fe(CN)_6$ | 1% |
| | $MgSO_4$ | 2% |
| | $H_2O$ | 97% |
| (6) | $K_4Fe(CN)_6$ | 1% |
| | $Ca(CH_3COO)_2$ | 2% |
| | $H_2O$ | 97% |
| (7) | $K_4Fe(CN)_6$ | 1% |
| | $CaCl_2$ | 2% |
| | $H_2O$ | 97% |

Cellulose filter rods having a circumference of 25.1 mm, a length of 36", an average weight of 9.82 mg/mm and a pressure drop of about 3" to about 4" per 25 mm were treated as follows. Eight 24" glass tubes having an internal diameter of 8 mm were lightly coated on the interior with talc and placed in a forced air oven at 105° C. for about 20 to 30 minutes to expand the glass. A 36" cellulose rod was quickly inserted into as much of the expanded 24" glass tube as possible and then impregnated under a vacuum with 50 ml of one of the stock solutions. All of the impregnated rods were then placed in an oven at 80° C. under continuous vacuum until totally dried.

The paper outer wrapper was then removed from the rods and the length of the rods trimmed to eliminate flimsiness. All rods were then weighed, measured and then carbonized by being passed through a die heated to 840° C. and contained in a chamber under an inert atmosphere. The carbonized rods were reweighed to determine the weight loss and remeasured to determine shrinkage during carbonization. A portion of sample rods 4 and 5 were not completely carbonized in the center. Therefore, this uncarbonized segment was detached, weighed and measured separately. These figures were not used to determine the percent weight loss. These before and after measurements are summarized in Table III below in which the sample numbers correspond to the stock solutions and samples 2 through 7 are comparative.

TABLE III

| | Cellulose Rod | | | Pyrolyzed Rod | | | | |
|---|---|---|---|---|---|---|---|---|
| Sample | length, mm | weight, mg | mg/mm | length, mm | weight, mg | mg/mm | % weight loss | linear shrinkage, % |
| 1 | 260 | 2,340 | 9.00 | 224 | 481.4 | 2.149 | 76.13 | 13.84 |
| 2 | 299 | 2,680 | 8.96 | 267 | 322.3 | 1.207 | 86.53 | 10.70 |
| 3 | 419 | 3,790 | 9.04 | 372 | 584.0 | 1.569 | 82.65 | 11.20 |
| 4 | 415 | 3,900 | 9.39 | 64/305 | 238.2/ 722.0 | 2.367 | 74.80 | 11.08 |
| 5 | 458 | 4,190 | 9.14 | 50/385 | 155.5/ 402.5 | 1.045 | 88.57 | 5.02 |
| 6 | 249 | 2,270 | 9.11 | 224 | 377.5 | 1.685 | 81.51 | 10.04 |
| 7 | 263 | 2,460 | 9.35 | 242 | 589.5 | 2.435 | 73.96 | 7.98 |

All seven rods were then divided into sections approximately 2" in length, ignited and the following observations recorded as summarized in table IV below.

TABLE IV

| Sample | Observation |
|---|---|
| 1 | Absolutely non-burning. |
| 2 | Moderate burn rate, leaving a black ash and a large quantity of unburned carbon residue. The specimen would not reignite. |
| 3 | Moderate burn rate, leaving a yellowish-white ash with complete burning. |
| 4 | Slow burn rate, with a yellowish-white ash interior and black ash exterior. Ash was mostly water-soluble. |
| 5 | Fast, complete burning with a white ash. |
| 6 | Moderate burn rate, uniformly greyish-white ash, resembling that of a cigarette. Complete combustion with little residual carbon. |
| 7 | Slow burn rate, with a black ash. Incomplete combustion. |

EXAMPLE 2

A carbon rod prepared as detailed in the preceding example employing stock solution (1) was cut into 15 mm lengths, and the lengths incorporated in cigarettes between the tobacco column and a conventional cellulose acetate filter, 5 mm in length. Thirty-two such experimental cigarettes were prepared, as were thirty-two control cigarettes, containing only a cellulose acetate filter 15 mm in length and a tobacco column. The cigarettes were subjected to TPM analysis and the average TPM value for the experimental cigarettes was found to be about 8.8 and for the control cigarettes was 14.7. The RTD values were determined for both the control and the experimental cigarettes and the average values were found to be 6.5" of water for both the experimental and the control cigarettes.

The 40.1% average decrease in TPM delivery reported for the experimental cigarettes over the average TPM delivery of the control cigarettes shows the enhanced filtration ability of the carbonized non-combustible cellulose rod over that of the traditional cellulose acetate filter.

EXAMPLES 3-6

The following examples illustrate the method of the invention carried out on a pilot-plant scale. A 100 cm-wide roll of cellulosic paper manufactured according to the fourdrinier process and having a basis weight of 31.6 gms/m$^2$ was employed. The roll was rotatably mounted on a horizontally disposed rotatable spindle and was advanced at a substantially constant rate past a sprayer which applied an aqueous salt solution to the web and then between a pair of horizontally disposed, grooved, cylindrical crimping rolls. Each crimping roll contained an annular array of parallel grooves spaced about 24 per inch; the rolls being disposed relative to each other such that as the paper passed between them a nip line is formed in the paper. Pneumatic means connected to the axes of the rollers applied a pressure of about 100 pounds per inch of nip line.

After the crimping rolls, the paper was advanced through a gathering garniture which effected a random folding of the paper in the direction that it was advanced. The randomly folded paper was then advanced through a Teflon tube during which it was subjected to microwave energy (2450 MHz, 750 watts) for a total residence time sufficient to dry the randomly folded paper in the form of a rigid rod.

The resultant rod was then pyrolyzed by being advanced through a heated die having a 9 mm diameter bore centered on its longitudinal axis and a conical inlet tapering from 13 mm at the surface of the die to the size of and communicating with the bore. The die was heated by means of thermostatically controlled electrical resistance elements and was contained in a box-like enclosure through which nitrogen gas was passed.

EXAMPLE 3

Employing the above-described equipment, a non-combustible rod was manufactured by crimping the paper, then spraying the crimped paper with an aqueous solution of 2% by weight $(NH_4)_2HPO_4$ and 1% by weight $Na_2B_4O_7$ for a time sufficient to deposit the salts on the paper web in a total amount of 3% of the weight of the paper on a dry weight basis, then gathering the wet paper and advancing the paper through the drying tube for a total residence time of ten seconds. The resultant treated rod, which had a weight of 0.5 gms/inch, was then pyrolyzed by advancing it through the die maintained at a temperature of 850° C. for a total residence time of 10 seconds. The resultant carbonized rod was 9 mm in diameter, had an open void volume of 95%, a breaking strength of 180 gms, a weight of 0.11 gms/inch, retained 22% of the weight of the precursor rod, and was non-combustible.

EXAMPLE 4

15 mm segments of the carbonized rod produced in Example 4 were used in fabricating cigarettes which had a 60 mm tobacco column and a 10 mm conventional acetate filter (8 denier per filament, 40,000 tow denier) abutting opposite ends of the carbonized rod. As a control, cigarettes were fabricated containing only a 60 mm tobacco column and a 25 mm conventional cellulosic acetate filter. The cigarettes containing the carbonized rod segment, when smoked, delivered 9 mg of TPM in a total of 8 puffs and had a RTD of 6 inches of water whereas the control cigarettes delivered 15 mg of TPM in a total of 8 puffs and had a comparable RTD.

EXAMPLE 5

Example 3 could be repeated substituting for the aqueous solution employed therein an aqueous solution of 2% by weight $(NH_4)_2HPO_4$ and 1% by weight $(NH_4)_2B_4O_7$ and it is expected that a non-combustible carbonized rod would be produced having properties substantially similar to those reported for the carbonized rod in Example 4.

EXAMPLE 6

Example 3 could be repeated substituting for the aqueous solution employed therein an aqueous solution of 2% by weight $K_2HPO_4$ and 1% by weight $K_2B_4O_7$ and it is expected that a non-combustible rod would be produced having properties substantially similar to those reported for the carbonized rod in Example 4.

Thus it is apparent from the foregoing examples that the present invention provides a method whereby a non-combustible filter may be made which, when incorporated in a cigarette or the like, releases less total particulate matter to the smoker than does a smoking article which contains a conventional cellulose acetate filter. Additional advantages to be derived from smoking articles incorporating the non-combustible carbonized material of the present invention as a filter are that, since the filter does not burn, the particulate material trapped by the filter cannot be released by its burning. And, since the filter does not burn, the smoker can smoke the cigarette down to the filter, thus enjoying the full amount of the tobacco without experiencing the noxious odors and unpleasant taste which can result when a conventional cellulose acetate filter begins to burn.

We claim:

1. A non-combustible filter for a smoking article, comprising up to about a 40 mm length of a carbonized material prepared by:

(a) contacting a sheet of porous cellulosic web material with a film-forming aqueous solution of an inorganic salt selected from the group consisting of alkali metal and ammonium silicates, carbonates, hydrophosphites, diphosphites, phosphites, hypophosphites, orthophosphates, diphosphates, triposphates, polymetaphosphates, peroxymonophosphates, peroxydiphosphates, orthoborates, metaborates, tetraborates and mixtures thereof so that the web material contains at least about 1% of the salt on a dry weight basis; then (b) laterally gathering and compressing the cellulosic material into a substantially cylindrical coherent bundle; and then (c) pyrolyzing the cellulosic material in an inert atmosphere at a temperature of at least about 700° C. such that at least about 15% of the initial weight of the cellulosic material remains after pyrolysis.

2. A filtered smoking article comprising a tobacco column and the non-combustible filter of claim 1.

3. A substantially cylindrical non-combustible filter for a cigarette comprising laterally folded interbonded fibers of pyrolyzed porous cellulosic web material, having a substantially random distribution and containing from about 0.4 to about 1.2 percent by weight of elementally determined, water-insoluble boron and phosphorous, said filter having a carbon content of at least about 75% by weight, a diameter of from about 5 mm to about 15 mm, a length of from about 4 mm to about 40 mm, a flexural strength of at least about 40 grams, a void space of from about 60% to about 95% and a resistance-to-draw of less than about 1 inch of water per inch of filter length.

4. The non-combustible filter of claim 1 wherein in step (a) the cellulosic material is contacted with the solution such that the cellulosic material contains from about 2% to about 6% by weight of the salt on a dry weight basis.

5. The non-combustible filter of claim 4 wherein the salt comprises a mixture of sodium tetraborate, potassium tetraborate or ammonium tetraborate and diammonium phosphate or dipotassium phosphate.

6. The non-combustible filter of claim 5 wherein the solution comprises sodium tetraborate and diammonium phosphate in a weight ratio of from about 3:1 to about 1:3.

7. The non-combustible filter of claim 1 wherein in step (b) the web material is laterally gathered and compressed such that it has a density, on a dry weight basis, of from about 0.1 to about 0.4 gram/cc, exclusive of additives.

8. The non-combustible filter of claim 1 wherein the sheet of web material is longitudinally crimped before it is laterally gathered and compressed into the substantially cylindrical coherent bundle.

* * * * *